US006428059B2

(12) United States Patent
Kobayashi et al.

(10) Patent No.: US 6,428,059 B2
(45) Date of Patent: Aug. 6, 2002

(54) LATCH DETECTOR FOR AUTOMOTIVE DOOR LOCKS

(75) Inventors: Fumio Kobayashi; Hitoshi Nakamura; Masakazu Akahori, all of Yokohama (JP)

(73) Assignee: OHI Seisakusho Co., Ltd., Kanagawa-ken (JP)

( * ) Notice: Subject to any disclaimer, the term of this patent is extended or adjusted under 35 U.S.C. 154(b) by 0 days.

(21) Appl. No.: 09/796,228

(22) Filed: Feb. 28, 2001

(30) Foreign Application Priority Data

Feb. 29, 2000 (JP) ..... P2000-054519

(51) Int. Cl.[7] ..... E05C 3/06
(52) U.S. Cl. ..... 292/216; 292/201; 292/DIG. 23
(58) Field of Search ..... 292/201, 216

(56) References Cited

U.S. PATENT DOCUMENTS 4,806,712 A * 2/1989 Hoffman et al. ..... 200/61.62
5,516,164 A * 5/1996 Kobayashi ..... 292/201
5,678,869 A 10/1997 Yoshikuwa
5,713,613 A * 2/1998 Horima et al. ..... 292/201
5,938,252 A * 8/1999 Uemura et al. ..... 292/201
6,048,003 A * 4/2000 Shimura ..... 292/216
6,264,253 B1 * 7/2001 Takaishi ..... 292/216

FOREIGN PATENT DOCUMENTS

| | | |
|---|---|---|
| GB | 2241889 | 3/2000 |
| JP | 61-49471 | 6/1981 |
| JP | 61049471 | 10/1986 |
| JP | 11-62347 | 3/1999 |

* cited by examiner

*Primary Examiner*—Teri Pham Luu
(74) *Attorney, Agent, or Firm*—Kilpatrick Stockton

(57) ABSTRACT

A latch detector for automotive door locks is provided. The latch detector includes a detector body 1 having a recess 1*a*, a latch 4 rotating in the receiving recess 1*a*, a detecting switch 10 attached to the detector body 1, for detecting the latch 4 being in its full-latching position or the opening position and a detecting member 9 having a first arm 9*c* extending into the recess 1*a* to be engageable with a cam part 4*c* of the latch 4 and a second arm 9*e* exposing on the other side of the detector body 1. The detecting switch 10 is positioned on the other side of the detector body 1 so as to be operated by the second arm 9*e* of the detecting member 9. With this waterproof arrangement, it is unnecessary to construct the detecting switch by a waterproof and expensive element.

7 Claims, 4 Drawing Sheets

LATCH DETECTOR FOR AUTOMOTIVE DOOR LOCKS

BACKGROUND OF THE INVENTION

The present invention relates generally to a latch detector for automotive door locks, which is arranged on the side of an automotive door panel. More particularly, the invention relates to the latch detector which is equipped with a switch for detecting the position of a latch included in the latch detector. This latch is engageable with a striker on the side of a vehicle body.

For example, Japanese Examined Patent Publication (kokoku) No. 61-49471 discloses a latch detector (or latch detecting device) for automotive door locks. In the prior art, the latch detector has a latch rotatably accommodated in a receiving recess formed on the surface side of a detector body. Engaging with a striker secured on the vehicle body or disengaging from the striker, this latch is adapted so as to occupy its opening position or full-latching position. The latch has a cam face formed on the periphery, for engagement with a detecting switch for detecting the latch being in the opening position or the full-latching position. The detecting switch is positioned in the vicinity of the cam face of the latch in the above receiving recess. In the latch's movement from the opening position to the full-latching position and vice versa, the detecting switch detects one projection on the cam face, so that the respective positions of the latch can be detected.

In the above-mentioned conventional latch detector, however, the detecting switch is positioned in the receiving recess. Into the receiving recess, rainwater and dusts can enter through an opening formed in the automotive door to accept the striker, with ease. Under such a situation, the latch detector has been required to form the detecting switch by waterproof and dustproof material. It means that the whole door-lock system including such a latch detector is high-priced in production, correspondingly.

SUMMARY OF THE INVENTION

It is therefore an object of the present invention to provide a latch detector for automotive door locks, which is low-priced and superior in waterproof performance thereby to provide a stable detection for a long period of time.

The above object of the present invention can be accomplished by a latch detector for automotive door locks, comprising a detector body shaped so as to be fixed on a movable end of an automotive door panel, the detector body being provided, on its one side opposing a vehicle body, with a recess; a latch rotatably accommodated in the recess so as to move to both a full-latching position to engage with a striker secured to the vehicle body and an opening position to separate from the striker, the latch being provided with a cam part; a detecting switch attached to the detector body, for detecting the latch being in the full-latching position or the opening position; and a detecting member pivoted to the detector body so as to communicate the recess with the other side of the detector body, the detecting member having a first arm extending into the recess to be engageable with the cam part of the latch and a second arm exposing on the other side of the detector body, the detecting member also being rotatable in cooperation with the latch moving from the opening position to the full-latching position, and vice versa. Additionally in the above-mentioned latch detector, the detecting switch is positioned on the other side of the detector body so as to be operated by the second arm of the detecting member.

With the above-mentioned structure of the latch detector of the invention, it is not required to form the detecting switch by a waterproof and expensive element since the detector body is provided, on the back (other) side causing the difficulty of rainwater and dusts to adhere thereto, with the detecting switch for detecting the position of the latch through the detecting member. Therefore, the detecting switch can be low-priced with its improved waterproof capability, providing the detection stabilized for a long period.

According to the second aspect of the invention, the cam part is identical to a recess formed on a lateral face of the latch, while the detecting member has a projection formed at a tip of the first arm to engage with the cam part.

According to the third aspect of the invention, the detector body has a communication hole formed to communicate the receiving recess with the other side of the detector body, for allowing the first arm of the detecting member to enter from the other side of the detector body to the recess therethrough.

According to the fourth aspect of the invention, the detector body is made of synthetic resin.

According to the fifth aspect of the invention, the cam part of the latch is made of synthetic resin.

According to the sixth aspect of the invention, the cam part is curved around a rotating center of the latch.

According to the seventh aspect of the invention, the above cam part may be formed by an uneven periphery of the latch.

These and other objects and features of the present invention will become more fully apparent from the following description and appended claims taken in conjunction with the accompany drawing.

DESCRIPTION OF THE PREFERRED EMBODIMENT

Figure 1:
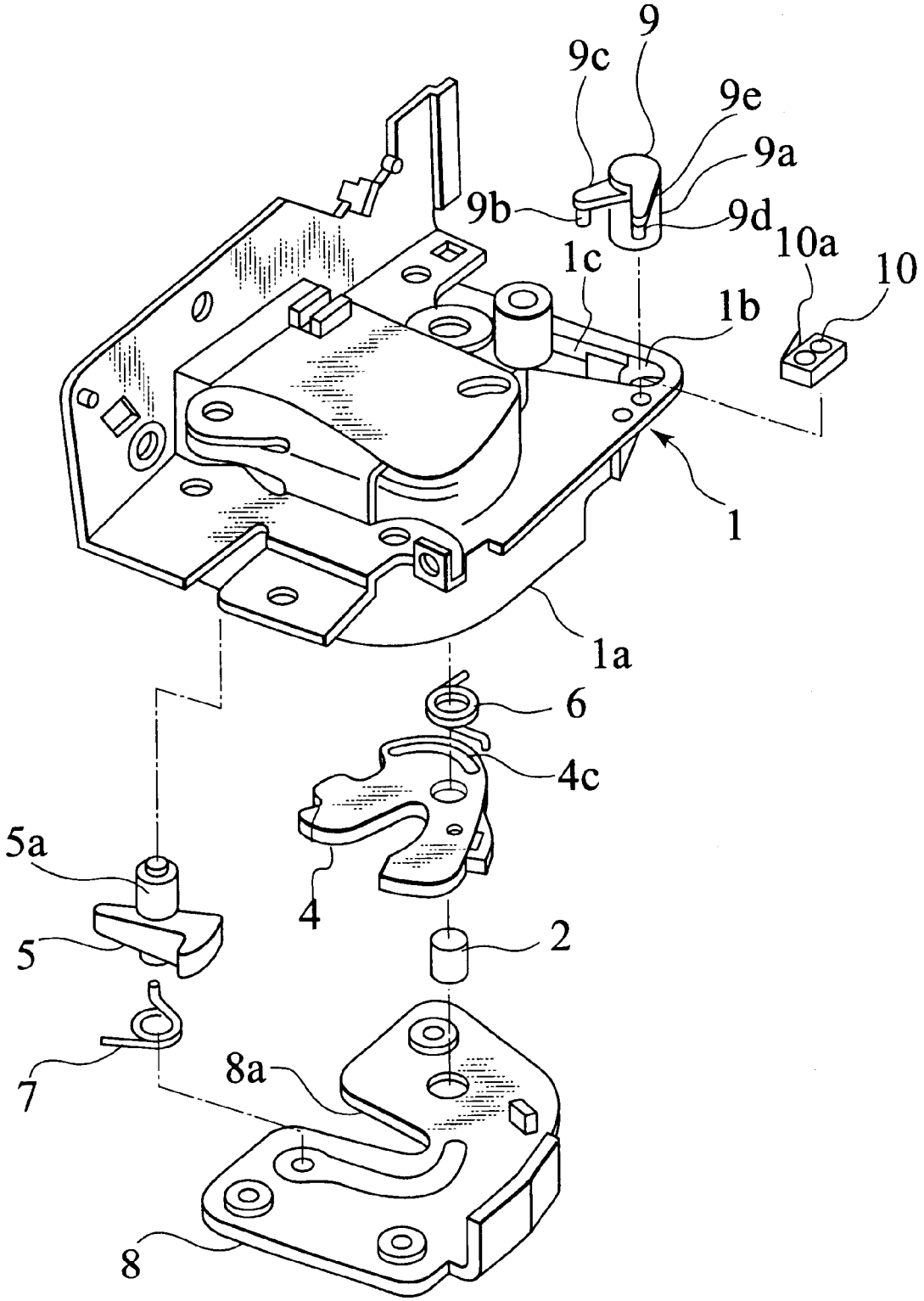
FIG. 1 is an exploded perspective view of a latch detector for automotive door locks in accordance with an embodiment of the present invention.

An embodiment of the present invention will be described with reference to the drawings. Note, in the following description, a right-and-oblique upward of FIG. 1 is defined as "upward" of the vehicle, a left-and-oblique downward of FIG. 1 as "downward", an upward of FIG. 1 as "forward", and a downward of FIG. 1 is defined as "backward" of the vehicle.

Reference numeral 1 denotes a box-shaped detector body which is made of synthetic resinous material. In the assembly, the detector body 1 is fixed on a not-shown movable end of an automotive door panel by means of a plurality of bolts (also not shown). The detector body 1 is provided, on its one side (i.e. surface side), with a receiving recess 1*a* for accommodating the later-mentioned elements therein. Noted that the detector body's side having the receiving recess 1*a* formed thereon is adapted so as to oppose a vehicle body (not shown) on condition that the automotive door panel is closed.

The detector body 1 further includes a bearing hole 1*b* formed on an upper corner of the detector body 1 and a communication hole 1*c* arranged near the bearing hole 1*b* to communicate the receiving recess 1*a* with the other side (i.e. back side) of the detector body 1. Note, the detector body is fixed on the automotive door panel while the other (back) side of the detector body 1 faces the interior of the door panel.

In the receiving recess 1*a*, there are accommodated a latch 4 and a pawl 5 in engagement. The latch 4 is pivoted to the receiving recess 1*a* through an axle 2. Corresponding to the opening-and-closing action of a vehicle door, the latch 4 is adapted so as to engage with a striker 3 or disengage from the striker 3. The striker 3 is secured on the side of the vehicle body. With this engagement or disengagement, the latch 4 is capable of occupying its full-latching position shown in FIGS. 2 and 3 and the opening position shown in FIG. 4 and further movable therebetween. Note, the latch 4 is provided, on its periphery, with a half-latching claw 4*a* and a full-latching claw 4*b*.

While, the pawl 5 is also pivoted to the receiving recess 1*a* through an axle part 5*a*. In operation, by the engagement with the half-latching claw 4*a* and the full-latching claw 4*b*, the pawl 5 serves to prevent the latch 4 from rotating to its "opening" direction (counterclockwise direction of FIGS. 2 and 3) allowing the door to be restricted to its semi-closing condition or full-closing condition.

The latch 4 is covered, on the whole periphery, with synthetic resin. Additionally, the latch 4 is provided, on its upper lateral side, with a cam part 4*c* in the form of a recess curved along the rotating direction of the latch 4. In detail, the cam part 4 is contoured so as to gradually increase a distance from the axle 2 in the clockwise direction (see FIG. 2).

Figure 2:
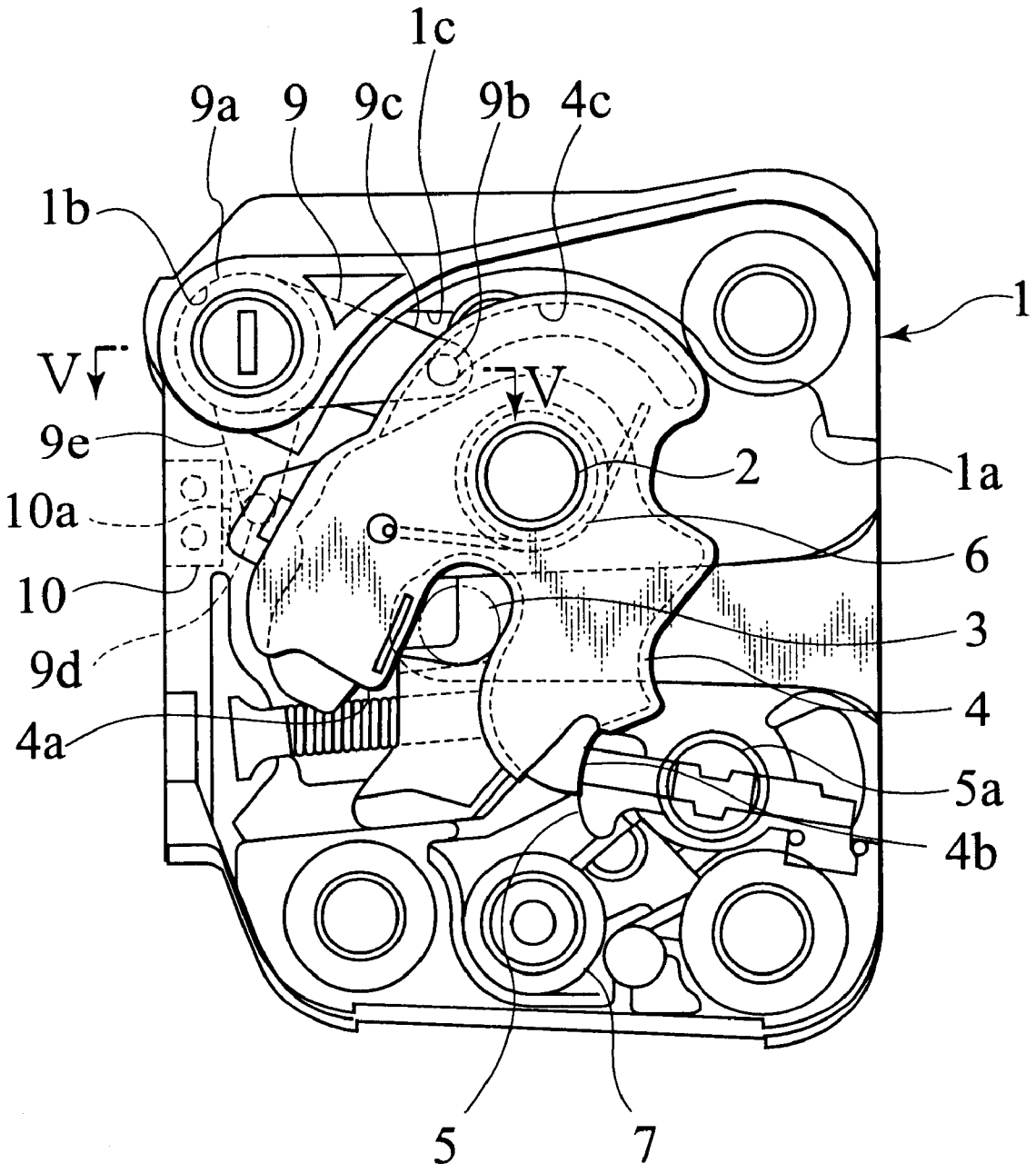
FIG. 2 is a rear view of the latch detector of the embodiment, showing its surface side of the vehicle body while removing a cover plate of the latch detector.

Reference numeral 6 designates a spring which gives the latch 4 an urging force in its opening direction (i.e. the counterclockwise direction of FIG. 2), while reference numeral 7 denotes another spring which gives the pawl 5 an urging force in its engaging direction (i.e. the clockwise direction of FIG. 2). Further, reference numeral 8 designates a metal cover plate which is fixed on the surface side of the detector body 1 to close the receiving recess 1*a*. The cover plate 8 is provided, at its substantial center in the upward-and-downward direction, with a notch 8*a* through which the striker 3 enters.

The detector body 1 is fixed to the door panel while opposing the surface side to the door panel and adjusting the notch 8*a* of the cover plate 8 with an opening (not shown) for striker formed in the door. Therefore, the receiving recess 1*a* of the detector body 1 is subjected to remarkably-unfavorable conditions since rainwater, dusts, etc. are easy to enter into the receiving recess 1*a* through openings in the door panel. To the contrary, the back side of the detector body 1 is arranged under favorable conditions in comparison with the receiving recess 1*a* because of difficulty of rainwater, dusts, etc. to enter into the back side.

Although there is arranged, on the back side of the detector body 1, a manipulation mechanism associated with a handle for opening/closing the door and a locking knob for locking/unlocking the door, both illustration and description of the above mechanism are eliminated because of no connection with the present invention.

Reference numeral 9 denotes a detecting member which is rotatably inserted into the bearing hole 1*b* of the detector body 1 to communicate the back side with the surface side. The detecting member 9 is adapted so as to rotate in cooperation with the movement of the latch 4.

Figure 4:
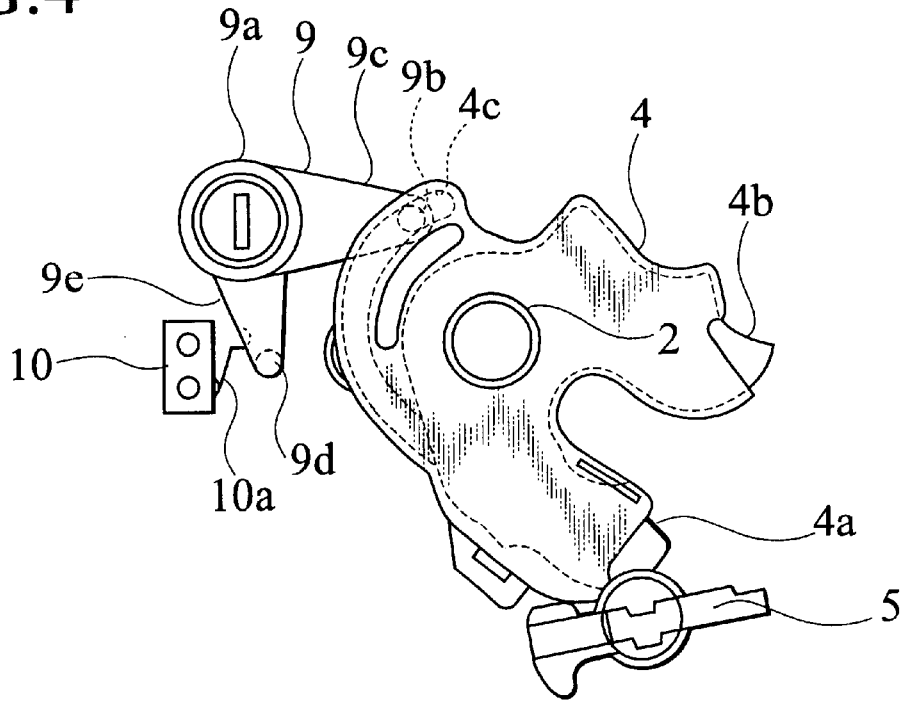
FIG. 4 is an explanatory operational view of the essential part of the latch detector having the latch in the opening position.
Figure 5:
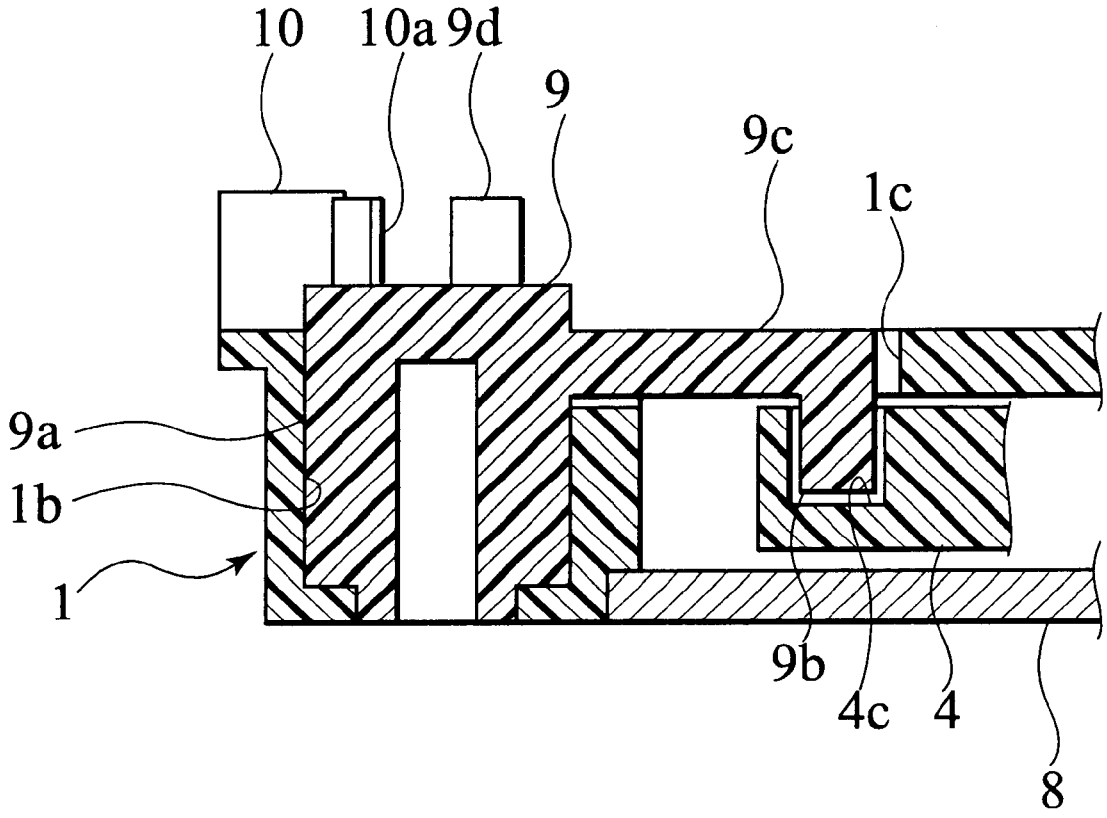
FIG. 5 is a cross sectional view taken along a line V—V of FIG. 2.

In detail, as shown in FIG. 5, the detecting member 9 includes a first arm 9*c* extending from the back side of the detector body 1 into the receiving recess 1*a* through the communication hole 1*c* and also having a projection 9*b* for engagement with the cam part 4*c* of the latch 4, and a second arm 9*e* extending along the back side of the detector body 1 and having a projection 9*d* formed at the tip of the second arm 9*e*. Cooperating with the movement of the latch 4 from the opening position to the full-latching position, the detecting member 9 is rotated from the position of FIG. 4 in the lockwise direction to occupy the positions of FIGS. 2 and 3.

Reference numeral 10 designates a detecting switch which is fixed on the back side of the detector body 1 to detect they moving of the second arm 9*e* of the detecting member 9, allowing the respective positions of the latch 4 to be detected respectively.

Thus, when the latch 4 occupies the opening position, the detecting member 9 has the projection 9*b* of the first arm 9*c* engaging with the end of the cam part 4*c* in the clockwise direction and the projection 9*d* of the second arm 9*e* separating from a detecting piece 10*a* of the detecting switch 10, as shown in FIG. 4.

Figure 3:
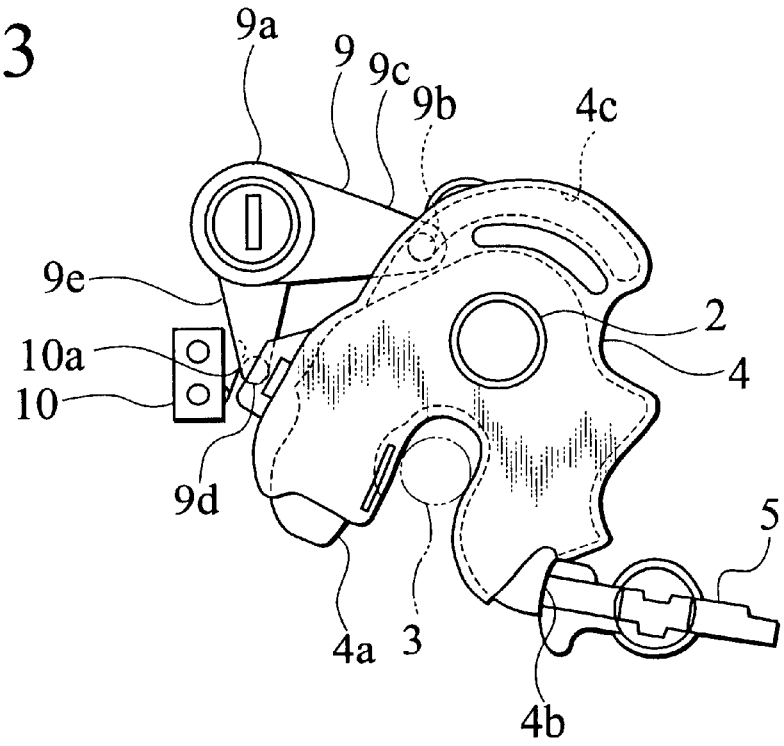
FIG. 3 is an explanatory operational view of an essential part of the latch detector having a latch in the full-latching position.

Next, when the latch 4 is rotated in the clockwise direction to move to the full-latching position, the detecting member 9 is also rotated in the clockwise direction since the projection 9*b* of the first arm 9*c* moves to the end of the cam part 4*c* in the counterclockwise direction, as shown in FIGS. 2 and 3. Then, the projection 9*d* of the second arm 9*e* is brought into contact with the detecting piece 10*a* of the detecting switch 10, so that it can detect the latch 4 being in the full-latching position, through the intermediary of the detecting member 9.

According to the embodiment mentioned above, since the detector body 1 is provided, on the back (other) side causing the difficulty of rainwater and dusts to adhere thereto, with the detecting switch 10 for detecting the position of the latch 4 through the detecting member 9, it is not required to form the detecting switch 10 by a waterproof and expensive element. Therefore, the detecting switch can be low-priced with its improved waterproof capability, providing the detection stabilized for a long period.

Additionally, since the cam part 4*c* of the latch 4 is in the form of a recess while the detecting member 9 has the projection 9*b* for engagement with the above recess (4*c*), the engagement between the cam part 4*c* and the first arm 9*c* of the detecting member 9 can be promoted to allow the movement of the latch 4 to be transmitted to the detecting member 9 certainly, accomplishing the improvement of detecting accuracy.

Further, according to the shown embodiment, the detector body 1 has the communication hole 1*c* formed to communicate the receiving recess 1*a* with the other side of the detector body 1, for allowing the first arm 9*c* of the detecting member 9 to enter from the other side of the detector body 1 to the receiving recess 1*a* therethrough. Consequently, the above arrangement allows the cam part 4*c* and the engaging part (9*b*) of the detecting member 9 to be constructed thinly, accomplishing the miniaturization of the detector body 1.

According to the embodiment, since the detector body 1 and the cam part of the latch 4 are both made of synthetic resin, the waterproof capability of the latch detector of the invention can be enhanced furthermore.

Finally, it will be understood by those skilled in the art that the foregoing description is merely related to one embodiment of the latch detector for automotive door locks, and various changes and modifications may be made to the present invention without departing from the spirit and scope thereof.

For example, the latch 4 may be formed with an uneven periphery which forms the above cam part 4*c* for engagement with the projection 9*b* of the first arm 9*c* of the detecting member 9.

What is claimed is:

1. A latch detector for automotive door locks, comprising:

a detector body shaped so as to be fixed on a movable end of an automotive door panel, the detector body being provided, on its one side opposing a vehicle body, with a receiving recess;

a latch rotatably accommodated in the receiving recess so as to move to both a full-latching position to engage with a striker secured to the vehicle body and an opening position to separate from the striker, the latch being provided with a cam part;

a detecting switch attached to the detector body, for detecting the latch being in the full-latching position or the opening position; and a detecting member pivoted to the detector body so as to communicate the receiving recess with the other side of the detector body, the detecting member having a first arm extending into the recess to be engageable with the cam part of the latch and a second arm exposing on the other side of the detector body, the detecting member also being rotatable in cooperation with the latch moving from the opening position to the full-latching position, and vice versa;

wherein the detecting switch is positioned on the other side of the detector body so as to be operated by the second arm of the detecting member.

2. The latch detector for automotive door locks as claimed in claim 1, wherein the cam part is identical to a recess formed on a lateral face of the latch, while the detecting member has a projection formed at a tip of the first arm to engage with the cam part.

3. The latch detector for automotive door locks as claimed in claim 2, wherein the detector body has a communication hole formed to communicate the receiving recess with the other side of the detector body, for allowing the first arm of the detecting member to enter from the other side of the detector body to the recess therethrough.

4. The latch detector for automotive door locks as claimed in claim 2, wherein the cam part is curved around a rotating center of the latch.

5. The latch detector for automotive door locks as claimed in claim 1, wherein the detector body is made of synthetic resin.

6. The latch detector for automotive door locks as claimed in claim 5, wherein the cam part of the latch is made of synthetic resin.

7. The latch detector for automotive door locks as claimed in claim 1, wherein the cam part is formed by an uneven periphery of the latch.

* * * * *